United States Patent [19]

Ciccarelli et al.

[11] Patent Number: 4,789,615

[45] Date of Patent: Dec. 6, 1988

[54] TONER COMPOSITIONS WITH NICOTINATE CHARGE ENHANCING ADDITIVES

[75] Inventors: Roger N. Ciccarelli, Rochester; Jacques C. Bertrand, Ontario, both of N.Y.

[73] Assignee: Xerox Corporation, Stamford, Conn.

[21] Appl. No.: 56,913

[22] Filed: Jun. 2, 1987

[51] Int. Cl.[4] ..... G03G 13/22; G03G 9/08; G03G 9/10

[52] U.S. Cl. ..... 430/126; 430/110

[58] Field of Search ..... 430/110, 126

[56] References Cited

U.S. PATENT DOCUMENTS

| | | | |
|---|---|---|---|
| 4,247,597 | 1/1981 | Russell | 430/110 X |
| 4,254,205 | 3/1981 | Lu et al. | 430/110 X |
| 4,298,672 | 11/1981 | Lu | 430/110 X |
| 4,404,271 | 9/1983 | Kawagishi et al. | 430/110 |
| 4,411,975 | 10/1983 | Lu et al. | 430/110 X |
| 4,664,670 | 5/1987 | Mehl et al. | 430/105 X |

FOREIGN PATENT DOCUMENTS

| | | | |
|---|---|---|---|
| 60-188959 | 9/1985 | Japan | 430/110 |
| 61-160757 | 7/1986 | Japan | 430/110 |

*Primary Examiner*—Roland E. Martin

*Attorney, Agent, or Firm*—E. O. Palazzo

[57] ABSTRACT

Negatively charged toner compositions comprised of resin particles, pigment particles, and as a charge enhancing additive metal salts of the following formula:

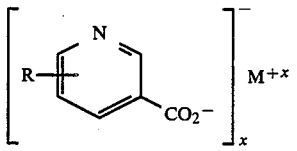

wherein R is selected from the group consisting of hydrogen and aliphatic substituents; each x is of equal value and represents the number 1, 2, or 3; and M is selected from the group consisting of hydrogen and metals.

53 Claims, No Drawings

TONER COMPOSITIONS WITH NICOTINATE CHARGE ENHANCING ADDITIVES

BACKGROUND OF THE INVENTION

The invention is generally directed to toner compositions, and more specifically, the present invention is directed to developer and toner compositions containing therein charge enhancing additives, which impact a negative charge to the toner resin particles. In one embodiment there is provided in accordance with the present invention toner compositions comprised of resin particles, pigment particles, and transparent negative charge enhancing additives, such as alumimum nicotinate. The aforementioned toner compositions are particularly useful with pigment particles comprised of, for example, carbon black, magnetites, cyan, magenta, yellow, blue, green, red, or brown components, thereby enabling compositions with these components to be selected for the development of black or colored images. Additionally, the charge additives illustrated herein are believed to be nontoxic in that, for example, they would generate an acceptable negative Ames test.

Developer compositions with charge enhancing additives, which impart a positive charge to the toner resin, are well known. Thus, for example, there is described in U.S. Pat. No. 3,893,935 the use of quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates. Further, there is disclosed in U.S. Pat. No. 4,298,672 positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 and 4,394,430.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there is disclosed in the '064 patent toner compositions with chromium, cobalt, and nickel complexes of salicylic acid as negative charge enhancing additives.

There is illustrated in U.S. Pat. No. 4,404,271, the disclosure of which is totally incorporated herein by reference, a complex system for developing electrostatic images with a toner which contains a metal complex represented by the formula in column 2, lines 20 to 31; and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Other prior art includes Japanese Publication No. 54-145542 which illustrates a negatively chargeable toner consisting of a resin, a colorant, and the charge control agent pyridoxine aliphatic acid ester; East German Patent Publication No. 218697 relating to liquid developers with charge control additives with structural units of formulas (I), (II) and (III), and which contains olefinically polymerizable bonds; U.S. Pat. No. 3,850,642 relating to multilayer sensitive elements with ionizable salts, acids, esters, and surfactants as charge control agents; U.S. Pat. No. 2,970,802 illustrating a composition for the control of hypercholestermia, which composition consists of a nontoxic gelatin containing aluminum nicotinate; and U.S. Pat. No. 3,072,659 which discloses a method of preparing aluminum salts of nicotinic acid.

Furthermore, there is disclosed in copending application U.S. Ser. No. 822,186, relating to toner compositions with negative charge enhancing additives, the disclosure of which is totally incorporated herein by reference, containing therein as negative charge enhancing additives iron complexes, including the iron complex of azo dyes prepared from coupling diazotized substituted amino phenols with substituted naphthols.

Although many charge enhancing additives are known, there continues to be a need for new additives, especially those that impart negative charges to toner resin particles. Additionally, there is a need for transparent negative charge enhancing additives which are useful for incorporation into black, or colored toner compositions. There is also a need for toner compositions with negative transparent charge enhancing additives that possess acceptable triboelectric charging characteristics, and suitable admixing properties. Moreover, there continues to be a need for humidity insensitive negatively charged toner and developer compositions. Further, there is a need for charge enhancing additives which can be easily and permanently dispersed into toner resin particles. There also is a need for negatively charged black, and colored toner compositions that are useful for incorporation into various imaging processes, inclusive of highlight trilevel color xerography, as illustrated in U.S. Pat. No. 4,078,929, the disclosure of which is totally incorporated herein by reference; laser printers; and additionally, the toner compositions of the present invention are useful in imaging apparatuses having incorporated therein layered photoresponsive imaging members, such as the members illustrated in U.S. Pat. No. 4,265,990, the disclosure of which is totally incorporated herein by reference. Furthermore, there is a need for negatively charged toner compositions with desirable and rapid toner admix charging characteristics.

SUMMARY OF THE INVENTION

It is an object of the present invention to provide toner and developer compositions with negative charge enhancing additives.

In another object of the present invention there are provided negatively charged toner compositions useful for the development of electrostatic latent images including color images.

In yet another object of the present invention there are provided negatively charged toner compositions containing as charge enhancing additives aluminum nicotinate, which additives are believed to be nontoxic.

Also, in another object of the present invention there are provided developer compositions with negatively charged toner particles, carrier particles, and aluminum nicotinate charge enhancing additives.

In yet a further object of the present invention there are provided humidity insensitive negatively charged toner compositions with desirable admix properties, less than 5 minutes for example, and acceptable triboelectric charging characterstics.

Additionally, in a further object of the present invention there are provided negatively charged magnetic toner compositions, and negatively charged colored toner compositions containing therein transparent aluminum nicotinates, and similar additives.

Furthermore, in yet another object of the present invention there are provided toner compositions with transparent negative charge enhancing additives, which compositions are useful in a variety of electrostatic imaging and printing processes, including trilevel color xerography.

These and other objects of the present invention are accomplished by providing toner compositions comprised of resin particles, pigment particles, and as enhancing additives metal salts of the following formula:

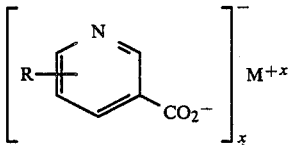

wherein R is hydrogen, or an aliphatic hydrocarbon, particularly an alkyl substituent of from about 1 to about 25 carbon atoms including, for example, methyl, ethyl, $CH_3(CH_2)_n$, wherein n is a number of from 2 to about 25, as well as the isomers thereof; each x is of equal value and represents the number 1, 2, or 3; and M is hydrogen or suitable metal substituents inclusive of lithium, sodium, potassium, magnesium, calcium, barium, iron, copper, zinc, chromium, and aluminum, with aluminum being preferred. With respect to the aforementioned substituents, there is preferably selected iron with a +3 or +2 valence, magnesium, calcium, copper, and zinc with +2 valence, hydrogen, lithium, potassium, and sodium with a +1 valence, and aluminum or chrominium with a +3 valence. These charge enhancing additives, which are commercially available, can be referred to as the metal or nonmetal acids and salts of pyridine carboxylic acids and alkyl pyridine carboxylic acids, examples of which include pyridine alpha-carboxylic acid; pyridine beta-carboxylic acid (nicotinic acid); and pyridine gamma-carboxylic acid (isonicotinic acid).

Illustrative examples of suitable toner resins selected for the toner and developer compositions of the present invention are polyamides, polyolefins, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters like esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylamide; vinyl ethers, such as vinyl methyl ether, vinyl isobutyl ether, vinyl ethyl ether, and the like; vinyl ketones such as vinyl methyl ketone, vinyl hexyl ketone, and methyl isopropenyl ketone; vinylidene halides such as vinylidene chloride, vinylidene chlorofluoride and the like; and N-vinyl indole, N-vinyl pyrrolidene and the like; styrene butadiene copolymers; and mixtures thereof.

As one preferred toner resin, there is elected the esterification products of a dicarboxylic acid and a diol comprising a diphenol. These resins are illustrated in U.S. Pat. No. 3,590,000, the disclosure of which is totally incorporated herein by reference. Other preferred toner resins include styrene/methacrylate copolymers, and styrene/butadiene copolymers; polyester resins obtained from the reaction of bisphenol A and propylene oxide; followed by the reaction of the resulting product with fumaric acid; and branched polyester resins resulting from the reaction of dimethylterephthalate, 1,3-butanediol, 1,2-propanediol, and pentaerythritol styrene acrylates; and mixtures thereof. Also, waxes with a molecular weight of from about 1,000 to about 6,000 such as polyethylene, polypropylene, and paraffin can be incorporated into the toner compositions as fuser roll release agents.

In an important embodiment of the present invention, there are admixed with the first resin particles, which first resins are present in an amount of from about 50 to about 70 percent by weight, second resin particles in an amount of from about 30 to about 10 percent by weight, illustrative examples of which include terpolymer resins, which resins are commercially available from Nippon Zeon Company, Ltd., a Japanese corporation; and are believed to be comprised of a terpolymer of styrene, acrylate, such as butylacrylate, and acrylonitrile. In one illustrative embodiment, it is believed that the Nippon Zeon Company, Ltd. terpolymer resin contains styrene in an amount of from about 55 percent by weight to about 65 percent by weight, butylacrylate in an amount of from about 30 percent by weight to about 35 percent by weight, and acrylonitrile in an amount of from about 5 percent by weight to about 10 percent by weight.

Moreover, there can be included in the toner composition low molecular weight waxes such as polypropylenes and polyethylenes commercially available from Allied Chemical and Petrolite Corporation, Epolene N-15, commercially available from Eastman Chemical Products, Inc., Viscol 550-P, a low molecular weight polypropylene available from Sanyo Kasei K.K., and similar materials. The commercially available polyethylenes selected have a molecular weight of from about 1,000 to about 1,500, while the commercially available polypropylenes incorporated into the toner compositions of the present invention are believed to have a molecular weight of from about 4,000 to about 5,000. Many of the polyethylene and polypropylene compositions useful in the present invention are illustrated in British Pat. No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

The resin particles are present in a sufficient, but effective amount, thus when 5 percent by weight of the charge enhancing additive is present, and 10 percent by weight of pigment or colorant such as carbon black is contained therein, about 85 percent by weight of resin is selected. Generally, from about 0.25 weight percent to about 10 weight percent, and preferably from about 1 weight percent to about 5 weight percent of the charge enhancing additive is selected for mixing with the toner particles; however, the charge enhancing additive of the present invention can be used in various other amounts providing the objectives of the present invention are accomplished. Also, the charge enhancing additive of the present invention can be blended into the toner composition or coated on the pigment particles. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black, nigrosine dye, aniline blue, and mixtures thereof. The pigment, which is preferably carbon black, should be present in a sufficient amount to render the toner composition highly colored. Generally, the pigment particles are present in amounts of from about 3 percent by weight to about 20 percent by weight, based on the total weight of the toner composition; however, lesser or greater amounts of pigment particles can be selected providing the objectives of the present invention are achieved.

When the pigment particles are comprised of magnetites, which are a mixture of iron oxides ($FeO.Fe_2O_3$) including those commercially available as Mapico Black, they are present in the toner composition in an amount of from about 10 percent by weight to about 70 percent by weight, and preferably in an amount of from about 10 percent by weight to about 50 percent by weight.

There can also be blended into the toner compositions of the present invention external additive particles including flow aid additives, which additives are usually present on the surface thereof. Examples of additives include colloidal silicas such as Aerosil, metal salts and metal salts of fatty acids inclusive of zinc stearate; aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Also encompassed within the scope of the present invention are colored toner and developer compositions comprised of toner resin particles, carrier particles, the charge enhancing additives illustrated herein, and as pigments or colorants magenta, cyan and/or yellow particles, as well as mixtures thereof. More specifically, with regard to the production of color images utilizing a developer composition with the charge enhancing additives of the present invention, illustrative examples of magenta materials that may be selected as pigments include, for example, 2,9-dimethyl-substituted quinacridone and anthraquinone dye identified in the color index as Cl 60710, Cl Dispersed Red 15, diazo dye identified in the color index as Cl 26050, Cl Solvent Red 19, and the like. Illustrative examples of cyan materials that may be used as pigments include copper tetra-4(octadecyl sulfonamido)phthalocyanine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected are diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a positive polarity enabling the toner particles which are negatively charged to adhere to and surround the carrier particles. Illustrative examples of carrier particles include iron powder, steel, nickel, iron ferrites, silicon dioxide, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating conductive substances such as carbon black in an amount of from about 5 to about 30 percent by weight.

Furthermore, the diameter of the carrier particles is generally from about 50 microns to about 1,000 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods including melt blending the toner resin particles, pigment particles or colorants, and the charge enhancing additive of the present invention; followed by mechanical attrition. Other methods include those well known in the art such as spray drying, melt dispersion, extrusion processing, dispersion polymerization, and suspension polymerization. In one method, a solvent dispersion of the resin particles, the pigment particles, and the charge enhancing additive are spray dried under controlled conditions to result in the desired product.

Additionally, the toner and developer compositions of the present invention may be selected for use in electrostatographic imaging apparatuses containing therein conventional photoreceptors providing that they are capable of being charged positively. This usually occurs with inorganic photoreceptors, illustrative examples of which include selenium, selenium alloys, halogen doped selenium substances, and halogen doped selenium alloys. Also, the toner and developer compositions of the present invention can be used with layered photoreceptors that are capable of being charged negatively, such as those described in U.S. Pat. No. 4,265,990, the disclosure of which is totally incorporated herein by reference. For the latter members, the discharged areas are developed with the toner compositions of the present invention. Other similar photoreceptors can be selected providing the objectives of the present invention are achievable.

The following examples are being supplied to further define various species of the present invention, it being noted that these examples are intended to illustrate and not limit the scope of the present invention. Parts and percentages are by weight unless otherwise indicated.

EXAMPLE I

There was prepared by melt blending, followed by mechanical attrition, a black negatively charged toner comprised of 62 percent by weight of a styrene n-butyl methacrylate copolymer (58/42), 18 percent by weight of second resin particles comprised of a terpolymer of styrene/butyl acrylate/acrylonitrile (63/32/5), 10 percent by weight of polypropylene wax commercially available from Sanyo as 550P, 8 percent by weight of carbon black (Black Pearls L), 20 percent by weight of the charge enhancing additive aluminum nicotinate commercially available from Mide Chemical Corporation, and as an external additive 0.2 percent by weight of Aerosil R972. Thereafter, a developer composition was prepared by admixing 3 percent by weight of the above-prepared toner composition with 97 percent by weight of steel carrier particles NV200R available from NTK, a Japanese corporation, and there was measured on the toner composition by the known Faraday Cage process a triboelectric charge of −12 microcoulombs per gram. Additionally, the admixing time of a developer composition comprised of the above ingredients with the exception that there was selected 1.5 percent by weight of the toner composition, and 98.5 percent by weight of the carrier particles; and there was added thereto 0.5 percent by weight of an identical toner composition, was 15 seconds as determined by the charge spectrograph.

Thereafter, the above-prepared developer composition with a triboelectric charge thereon of −12 microcoulombs per gram was inserted into a xerographic imaging test fixture available as the Royal Bond 130$^R$ machine containing therein a positively charged selenium (99 percent) arsenic alloy photoreceptor. There were generated 4,000 developed copies of excellent resolution with no background deposits at which time the test was terminated.

EXAMPLE II

A black negatively charged toner was prepared by repeating the procedure of Example I with the exception that there was selected 0 percent by weight of the charge enhancing additive and 82 percent by weight of the first and second resin particles. The triboelectric charge on the toner was a −7 microcoulombs per gram, and the admix charging time was 10 minutes. Additionally, when the aformentioned developer was incorporated into the Royal Bond 130$^R$ machine of Example I, there resulted images with unacceptable high backgrounds.

EXAMPLE III

There was prepared a negatively charged red toner by repeating the procedure of Example I with the exception that there was selected 84.6 percent by weight of a styrene butadiene copolymer (91/9) available as Pliolite from Goodyear; 9.6 percent by weight of Lithol Scarlet pigment; 0.8 percent of a magenta dispersion containing 50 percent of Hostaperm Pink E pigment, and 50 percent of a styrene n-butyl methacrylate copolymer (65/35); and 5 percent by weight of the aluminum nicotinate charge enhancing additive.

Subsequently, a developer composition was prepared by repeating the procedure of Example I with the exception that there was selected as the carrier particles Hoeganaes uncoated oxidized core, and there resulted on the toner a triboelectric charge of −13.4 microcoulombs per gram as measured in a Faraday Cage. Additionally, the admix time determined by repeating the procedure of Example I was 15 seconds.

Thereafter, the aforementioned developer composition was incorporated into a trilevel xerographic imaging apparatus, reference U.S. Pat. No. 4,078,929, the disclosure of which is totally incorporated herein by reference, with a layered photoresponsive member comprised of an aluminum supporting substrate, a photogenerating layer of trigonal selenium, and a charge transport layer comprised of 55 percent by weight of molecules of N,N'-diphenyl-N,N'-bis(3-methylphenyl)-1,1-biphenyl-4,4'-diamine dispersed in 45 percent by weight of a polycarbonate resin commercially available as Makrolon, reference U.S. Pat. No. 4,265,990, the disclosure of which has been totally incorporated herein by reference, and which imaging member was negatively charged; and there resulted 300 red images of excellent resolution and with no background deposits.

EXAMPLE IV

A red toner composition was prepared by repeating the procedure of Example III with the exception that there was selected 0 percent by weight of the charge enhancing additive aluminum nicotinate, and 89.6 percent by weight of the Pliolite resin. The triboelectric charge on the toner was determined to be a −10 microcoulombs per gram and the admix time was 10 minutes.

Other modifications of the present invention will occur to those skilled in the art based upon a reading of the disclosure of the present application and these modifications are intended to be included within the scope of the present invention.

What is claimed is:

1. A negatively charged toner composition comprised of resin particles, pigment particles, and as a charge enhancing additive metal salts of the following formula:

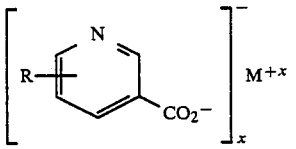

wherein R is selected from the group consisting of hydrogen and aliphatic substituents; each x is of equal value and represents the number 1, 2, or 3; and M is aluminum.

2. A toner composition in accordance with claim 1 wherein R is selected from the group consisting of hydrogen, methyl, ethyl and $CH_3(CH_2)_n$ wherein n is a number of 2 to about 20.

3. A toner composition in accordance with claim 1 wherein the charge enhancing additive is aluminum nicotinate.

4. A toner composition in accordance with claim 1 wherein the charge enhancing additive is present in an amount of from about 1 to about 10 percent by weight.

5. A toner composition in accordance with claim 1 wherein the resin particles are comprised of styrene polymers or mixtures thereof.

6. A toner composition in accordance with claim 1 wherein the resin particles are comprised of a styrene butylmethacrylate.

7. A toner composition in accordance with claim 1 wherein the resin particles are comprised of a polyester.

8. A toner composition in accordance with claim 1 wherein the resin particles are comprised of first resin particles and second resin particles.

9. A toner composition in accordance with claim 8 wherein the second resin particles are comprised of terpolymers.

10. A toner composition in accordance with claim 9 wherein the terpolymer is a styrene methyl methacrylate acrylonitrile.

11. A toner composition in accordance with claim 8 wherein there is included in the toner composition a wax component with a weight average molecular weight of from about 1,000 to about 6,000.

12. A toner composition in accordance with claim 11 wherein the waxy component is selected from the group consisting of polyethylene and polypropylene.

13. A toner composition in accordance with claim 1 further including therein as external additives metal salts of a fatty acid, colloidal silicas, or mixtures thereof.

14. A toner composition in accordance with claim 13 wherein the metal salt is zinc stearate.

15. A toner composition in accordance with claim 13 wherein the colloidal silica is Aerosil.

16. A toner composition in accordance with claim 1 wherein the pigment particles are carbon black.

17. A toner composition in accordance with claim 1 wherein the pigment particles are selected from the group consisting of cyan, magenta, yellow, red, blue, green, brown, and mixtures thereof.

18. A toner composition in accordance with claim 17 wherein the cyan pigment is a phthalocyanine.

19. A toner composition in accordance with claim 17 wherein the magenta pigment is Hostaperm Pink E or Fanal Pink.

20. A toner composition in accordance with claim 17 wherein the yellow pigment is Permanent Yellow.

21. A toner composition in accordance with claim 17 wherein the red pigment is Fanchome Red.

22. A toner composition in accordance with claim 17 wherein the green pigment is a blend of Permanent Yellow and Sudan Blue or PL Fast Blue.

23. A developer composition comprised of the toner composition of claim 1 and carrier particles.

24. A developer composition in accordance with claim 23 wherein the carrier particles are comprised of ferrites.

25. A developer composition in accordance with claim 23 wherein the carrier particles are comprised of an iron powder.

26. A developer composition in accordance with claim 23 wherein the carrier particles consist of a core with a coating thereover.

27. A developer composition in accordance with claim 26 wherein the coating is a methyl terpolymer, or a polymethyl methacrylate.

28. A developer composition comprised of the toner composition of claim 8 and carrier particles.

29. A developer composition in accordance with claim 28 wherein the second resin particles for the toner are comprised of a terpolymer of styrene methyl methacrylate acrylonitrile.

30. A developer composition comprised of the toner composition of claim 9 and carrier particles.

31. A developer composition in accordance with claim 28 wherein the carrier particles are comprised of ferrites.

32. A developer composition in accordance with claim 28 wherein the carrier particles are comprised of an iron powder.

33. A method of imaging which comprises formulating an electrostatic latent image on a positively or negatively charged photoreceptor, affecting development thereof with the toner composition of claim 1, and thereafter transferring the developed image to a suitable substrate.

34. A method of imaging in accordance with claim 33 wherein the transferred image is permanently fixed to the substrate.

35. A method of imaging in accordance with claim 33 wherein the negative charge enhancing additive is aluminum nicotinate.

36. A method of imaging in accordance with claim 33 wherein the resin particles are comprised of styrene polymers, or mixtures thereof.

37. A method of imaging in accordance with claim 33 wherein the pigment particles for the toner composition are carbon black.

38. A method of imaging in accordance with claim 33 wherein the pigment particles for the toner composition are selected from the group consisting of cyan, magenta, yellow, blue, green, red, brown, and mixtures thereof.

39. A method of imaging which comprises formulating an electrostatic latent image on a positively or negatively charged photoreceptor, affecting development thereof with the toner composition of claim 8, and thereafter transferring the developed image to a suitable substrate.

40. A method of imaging in accordance with claim 39 wherein the transferred image is permanently fixed to the substrate.

41. A method of imaging in accordance with claim 39 wherein the negative charge enhancing additive is aluminum nicotinate.

42. A method of imaging in accordance with claim 39 wherein the resin particles are comprised of styrene polymers, or mixtures thereof.

43. A method of imaging in accordance with claim 39 wherein the pigment particles for the toner composition are carbon black.

44. A method of imaging in accordance with claim 39 wherein the pigment particles for the toner composition are selected from the group consisting of cyan, magenta, yellow, blue, green, red, brown, and mixtures thereof.

45. A toner composition in accordance with claim 3 wherein the charge enhancing additive is present in an amount of from about 1 to about 10 percent by weight.

46. A toner composition in accordance with claim 3 wherein the resin particles are selected from the group consisting of styrene polymers, mixtures containing styrene polymers, polyesters, and terpolymers.

47. A toner composition in accordance with claim 3 further including therein as external additives metal salts of a fatty acid, colloidal silicas, or mixtures thereof.

48. A developer composition which comprises the toner composition of claim 3 and carrier particles.

49. A toner composition in accordance with claim 1 wherein M is aluminum.

50. A toner composition in accordance with claim 49 wherein the charge enhancing additive is present in an amount of from about 1 to about 10 percent by weight.

51. A toner composition in accordance with claim 49 wherein the resin particles are selected from the group consisting of styrene polymers, mixtures containing styrene polymers, polyesters, and terpolymers.

52. A toner composition in accordance with claim 49 further including therein as external additives metal salts of a fatty acid, colloidal silicas, or mixtures thereof.

53. A developer composition which comprises the toner composition of claim 49 and carrier particles.

* * * * *